US009568934B2

(12) United States Patent
Hong

(10) Patent No.: US 9,568,934 B2
(45) Date of Patent: Feb. 14, 2017

(54) SEMICONDUCTOR DEVICE AND SEMICONDUCTOR SYSTEM INCLUDING THE SAME

(71) Applicant: SK hynix Inc., Icheon-si, Gyeonggi-do (KR)

(72) Inventor: Yun Seok Hong, Icheon-si (KR)

(73) Assignee: SK HYNIX INC., Icheon-si (KR)

( * ) Notice: Subject to any disclaimer, the term of this patent is extended or adjusted under 35 U.S.C. 154(b) by 0 days.

(21) Appl. No.: 14/850,126

(22) Filed: Sep. 10, 2015

(65) Prior Publication Data

US 2016/0334827 A1 Nov. 17, 2016

(30) Foreign Application Priority Data

May 14, 2015 (KR) ..... 10-2015-0067524

(51) Int. Cl.
*G05F 3/16* (2006.01)

(52) U.S. Cl.
CPC ..... *G05F 3/16* (2013.01)

(58) Field of Classification Search
CPC ..... H03K 3/012; H03K 17/102; H03K 17/16; H03K 17/693; H03K 19/0016; H03K 19/00315; G06F 1/28; G06F 1/3209; G06F 11/1441; G06F 11/2015; G06F 1/3215; G06F 1/3225; G06F 3/0346
USPC ..... 327/540, 541, 542, 543
See application file for complete search history.

(56) References Cited

U.S. PATENT DOCUMENTS

2006/0232297 A1 10/2006 Tanimoto
2012/0033506 A1* 2/2012 Furutani ..... G11C 5/147 365/189.07

FOREIGN PATENT DOCUMENTS

KR 1020140146330 A 12/2014

* cited by examiner

*Primary Examiner* — John Poos
(74) *Attorney, Agent, or Firm* — William Park & Associates Ltd.

(57) ABSTRACT

A semiconductor system may include a first semiconductor device configured to output a command signal, a first power supply voltage, a second power supply voltage and a third power supply voltage. The semiconductor system may include a second semiconductor device configured to drive an internal power supply voltage with the first power supply voltage in response to an internal command signal generated by decoding the command signal, generate first output data from first internal data by being supplied with the internal power supply voltage and the second power supply voltage, and generate second output data from second internal data by being supplied with the internal power supply voltage and the second power supply voltage.

22 Claims, 8 Drawing Sheets

SEMICONDUCTOR DEVICE AND SEMICONDUCTOR SYSTEM INCLUDING THE SAME

CROSS-REFERENCE TO RELATED APPLICATION

The present application claims priority under 35 U.S.C. §119(a) to Korean application number 10-2015-0067524, filed on May 14, 2015, in the Korean Intellectual Property Office, which is incorporated herein by reference in its entirety.

BACKGROUND

1. Technical Field

Embodiments of the present disclosure generally relate to a semiconductor device and a semiconductor system.

2. Related Art

In general, a portable appliance such as a mobile phone and a notebook computer are equipped with batteries for supplying power. As the power consumption of a semiconductor device used in the portable appliance is reduced, the run time of the battery may be increased. In the case of a portable appliance, as related technologies are developed, a high operation speed is required, and thus, the data transmission speed of a semiconductor device serves as an important factor that determines the operation speed of the portable appliance.

A semiconductor device includes an output data generation circuit for generating and outputting output data. The output data generation circuit operates by being supplied with a power supply voltage. With regards to a read operation, the output data generation circuit drives output data from internal data and thereby outputs the output data to an exterior of the semiconductor device. If the power supply voltage is supplied to the output data generation circuit even while the output data generation circuit does not operate, the current consumption of the semiconductor device cannot help but increase. Also, a driving force for the output data generation circuit to drive output data exerts an influence on an operation speed at which internal data is outputted from the semiconductor device. In the case where the driving force of the output data generation circuit is poor, the operation speed of the semiconductor device may become slow, and the precision of output data may be degraded, by which a mis-operation may be caused.

SUMMARY

According to an embodiment, there may be provided a semiconductor system. The semiconductor system may include a first semiconductor device configured to output a command signal, a first power supply voltage, a second power supply voltage and a third power supply voltage. The semiconductor system may include a second semiconductor device configured to drive an internal power supply voltage with the first power supply voltage in response to an internal command signal generated by decoding the command signal, generate first output data from first internal data by being supplied with the internal power supply voltage and the second power supply voltage, and generate second output data from second internal data by being supplied with the internal power supply voltage and the second power supply voltage.

According to an embodiment, there may be provided a semiconductor device. The semiconductor device may include an internal power supply voltage driving block configured to drive an internal power supply voltage with a first power supply voltage in response to an internal command signal. The semiconductor device may include a first output data generation block configured to be supplied with the internal power supply voltage and a second power supply voltage, and may generate first output data from first internal data. The semiconductor device may include a second output data generation block configured to be supplied with the internal power supply voltage and the second power supply voltage, and may generate second output data from second internal data.

According to an embodiment, there may be provided a semiconductor device. The semiconductor device may include an internal power supply voltage driving block configured to drive an internal power supply voltage with a first power supply voltage in response to an internal command signal when a read operation is being performed. The semiconductor device may include a driving signal generation unit configured to be supplied with a second power supply voltage, and may generate a pull-up signal and a pull-down signal in response to internal data. The semiconductor device may include an output driver configured to be supplied with the internal power supply voltage, and may drive output data in response to the pull-up signal and the pull-down signal.

DETAILED DESCRIPTION

Hereinafter, a semiconductor device and a semiconductor system including the same will be described below with reference to the accompanying drawings through various examples of embodiments.

Various embodiments may be directed to a semiconductor system capable of increasing driving force and reducing leakage current.

According to some embodiments, since an internal power supply voltage may be supplied to an output data generation block only in a read operation, advantages may be provided in that current consumption may be reduced.

According to some embodiments, since a voltage higher than a voltage supplied to an output driver may be supplied to a pre-diver, advantages may be provided in that the driving force of output data may be increased.

Figure 1:
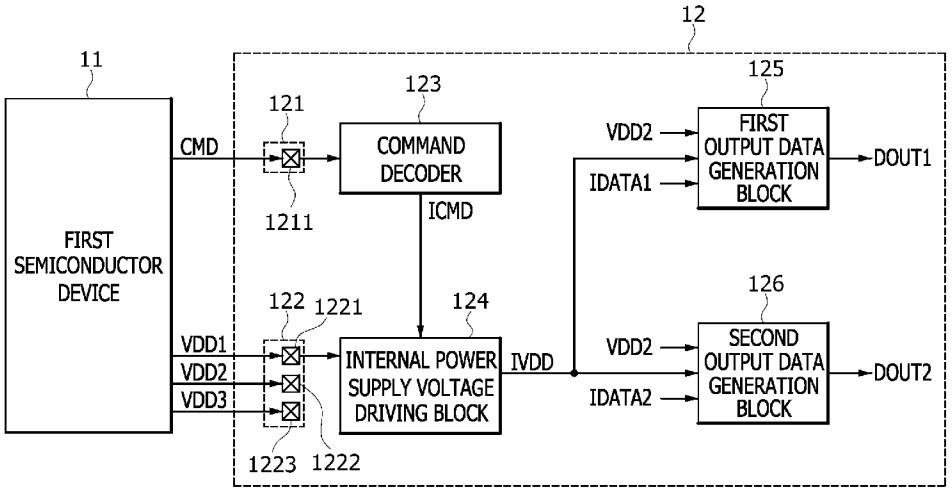
FIG. 1 is a block diagram illustrating a representation of an example of the configuration of a semiconductor system in accordance with an embodiment.

Referring to FIG. 1, a semiconductor system in accordance with an embodiment may include a first semiconductor device 11 and a second semiconductor device 12.

The first semiconductor device 11 may apply a command signal CMD, a first power supply voltage VDD1, a second power supply voltage VDD2 and a third power supply voltage VDD3 to the second semiconductor device 12. The command signal CMD may be applied to the second semiconductor device 12 through the same transmission lines (not illustrated) used for an external addresses (not illustrated) or may be applied to the second semiconductor device 12 through different transmission lines (not illustrated). The first power supply voltage VDD1 may be set to have a level lower than the second power supply voltage VDD2, and the second power supply voltage VDD2 may be set to have a level lower than the third power supply voltage VDD3. According to an embodiment, the first power supply voltage VDD1, the second power supply voltage VDD2 and the third power supply voltage VDD3 may be generated in the second semiconductor device 12.

The second semiconductor device 12 may include a first pad block 121, a second pad block 122, and a command decoder 123. The second semiconductor device 12 may include an internal power supply voltage driving block 124, a first output data generation block 125, and a second output data generation block 126.

The first pad block 121 may include a first pad 1211. The command signal CMD may be inputted to the command decoder 123 through the first pad 1211. The command signal CMD may include a plurality of signals. In the case where the command signal CMD includes a plurality of signals, the first pad block 121 may include a plurality of pads configured to be inputted with the plurality of signals.

The second pad block 122 may include a second pad 1221, a third pad 1222, and a fourth pad 1223. The second semiconductor device 12 may be supplied with the first power supply voltage VDD1 through the second pad 1221. The second semiconductor device 12 may be supplied with the second power supply voltage VDD2 through the third pad 1222. The second semiconductor device 12 may be supplied with the third power supply voltage VDD3 through the fourth pad 1223.

The command decoder 123 may decode the command signal CMD inputted through the first pad 1211, and may generate an internal command signal ICMD. The internal command signal ICMD may be enabled to a logic high level in the example where a read operation is being performed. A logic level at which the internal command signal ICMD is enabled may be realized in a variety of ways according to various embodiments.

The internal power supply voltage driving block 124 may drive an internal power supply voltage IVDD with the first power supply voltage VDD1 in response to the internal command signal ICMD. The internal power supply voltage driving block 124 may drive the internal power supply voltage IVDD with the first power supply voltage VDD1 in the example where the read operation is being performed. The internal power supply voltage driving block 124 may be positioned adjacent to the second pad 1221 through which the first power supply voltage VDD1 is inputted. The configuration and operation of the internal power supply voltage driving block 124 will be described later with reference to FIG. 2.

The first output data generation block 125 may be supplied with the internal power supply voltage IVDD and the second power supply voltage VDD2, and may generate first output data DOUT1 from first internal data IDATA1. In a read operation, the first internal data IDATA1 may be outputted from a memory cell array (not illustrated) included in the second semiconductor device 12. The configuration and operation of the first output data generation block 125 will be described later with reference to FIGS. 3 and 4.

The second output data generation block 126 may be supplied with the internal power supply voltage IVDD and the second power supply voltage VDD2, and may generate second output data DOUT2 from second internal data IDATA2. In the read operation, the second internal data IDATA2 may be outputted from a memory cell array (not illustrated) included in the second semiconductor device 12. The configuration and operation of the second output data generation block 126 will be described later with reference to FIGS. 5 and 6.

Figure 2:
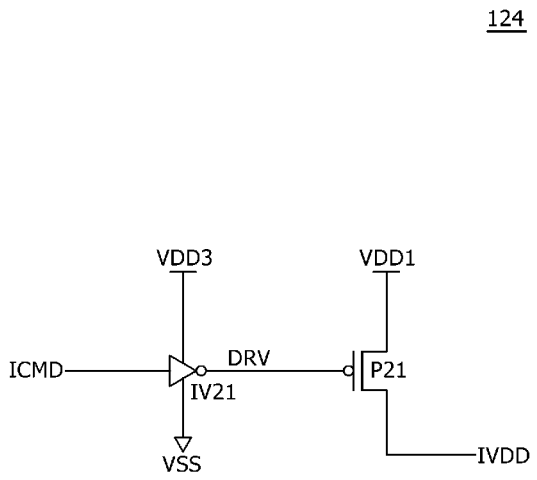
FIG. 2 is a diagram illustrating a representation of an example of the configuration of the internal power supply voltage driving block illustrated in FIG. 1.

Referring to FIG. 2, the internal power supply voltage driving block 124 may include an inverter IV21 and a PMOS transistor P21. The inverter IV21 may be supplied with the third power supply voltage VDD3 and a ground voltage VSS. The inverter IV21 may operate as a buffer element inverting and buffering the internal command ICMD and may generate a driving control signal DRV. The PMOS transistor P21 may operate as a driving element. The PMOS transistor P21 may be turned on in response to the driving control signal DRV and may drive the internal power supply voltage IVDD with the first power supply voltage VDD1.

The internal power supply voltage driving block 124 may drive the driving control signal DRV with the level of the ground voltage VSS according to the internal command ICMD which is enabled to the logic high level when the read operation is being performed, and may drive the internal power supply voltage IVDD with the first power supply voltage VDD1. The internal power supply voltage driving block 124 may drive the driving control signal DRV with the level of the third power supply voltage VDD3 according to the internal command ICMD. which is disabled to a logic low level when the read operation is not being performed. Since the third power supply voltage VDD3 applied to the gate terminal of the PMOS transistor P21 has a level higher than the first power supply voltage VDD1 supplied to the source terminal of the PMOS transistor P21, leakage current through the PMOS transistor P21 may be reduced.

Figure 3:
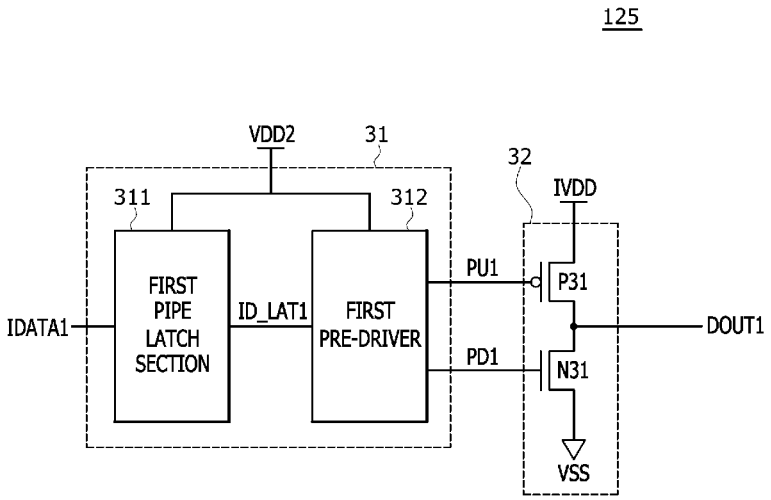
FIG. 3 is a diagram illustrating a representation of an example of the configuration of the first output data generation block illustrated in FIG. 1.

Referring to FIG. 3, the first output data generation block 125 may include a first driving signal generation unit 31 and a first output driver 32.

The first driving signal generation unit 31 may include a first pipe latch section 311 and a first pre-driver 312. The first pipe latch section 311 may be supplied with the second power supply voltage VDD2, may align and latch the first internal data IDATA1, and may output first latch data ID_LAT1. The first pre-driver 312 may be supplied with the second power supply voltage VDD2, and may generate a first pull-up signal PU1 and a first pull-down signal PD1 in response to the first latch data ID_LAT1.

The first output driver 32 may include a PMOS transistor P31 and an NMOS transistor N31. The PMOS transistor P31 may drive the first output data DOUT1 with the internal power supply voltage IVDD in response to the first pull-up signal PU1. The NMOS transistor N31 may drive the first output data DOUT1 with the ground voltage VSS in response to the first pull-down signal PD1.

Hereinbelow, operations of the first driving signal generation unit 31 and the first output driver 32 will be described by being divided into the examples where the first internal data IDATA1 is a logic high level and the examples where the first internal data IDATA1 is a logic low level.

In the example where the first internal data IDATA1 is the logic high level, the first driving signal generation unit 31 may generate the first pull-up signal PU1 and the first pull-down signal PD1 which are driven to the level of the ground voltage VSS. The first output driver 32 may be inputted with the first pull-up signal PU1 and the first pull-down signal PD1, and may drive the first output data DOUT1 with the internal power supply voltage IVDD.

In the example where the first internal data IDATA1 is the logic low level, the first driving signal generation unit 31 generates the first pull-up signal PU1 and the first pull-down signal PD1 which are driven to the level of the second power supply voltage VDD2. The first output driver 32 may be inputted with the first pull-up signal PU1 and the first pull-down signal PD1, and may drive the first output data DOUT1 with the ground voltage VSS. Since the second power supply voltage VDD2 applied to the gate terminal of the PMOS transistor P31 has a level higher than the internal power supply voltage IVDD supplied to the source terminal of the PMOS transistor P31, leakage current through the PMOS transistor P31 may be reduced. Since the second power supply voltage VDD2 applied to the gate terminal of the NMOS transistor N31 has the level higher than the internal power supply voltage IVDD supplied to the first output driver 32, the driving force of the NMOS transistor N31 may be increased.

Figure 4:
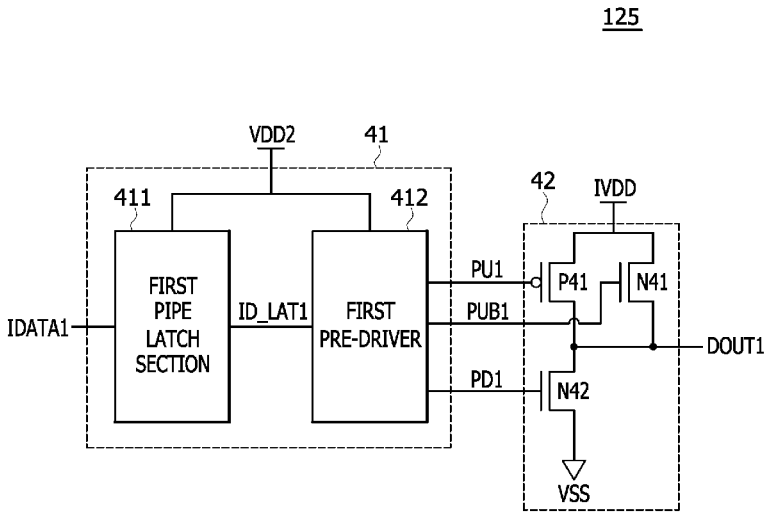
FIG. 4 is a diagram illustrating a representation of an example of the configuration of the first output data generation block illustrated in FIG. 1.

FIG. 4 is a diagram illustrating a representation of an example of the configuration of the first output data generation block 125 illustrated in FIG. 1. Referring to FIG. 4, a first driving signal generation unit 41 may include a first pipe latch section 411 and a first pre-driver 412. The first pipe latch section 411 may be supplied with the second power supply voltage VDD2, may align and latch the first internal data IDATA1, and may output first latch data ID_LAT1. The first pre-driver 412 may be supplied with the second power supply voltage VDD2, and may generate a first pull-up signal PU1, a first inverted pull-up signal PUB1 and a first pull-down signal PD1 in response to the first latch data ID_LAT1.

A first output driver 42 may include a PMOS transistor P41 and NMOS transistors N41 and N42. The PMOS transistor P41 may drive the first output data DOUT1 with the internal power supply voltage IVDD in response to the first pull-up signal PU1. The NMOS transistor N41 may drive the first output data DOUT1 with the internal power supply voltage IVDD in response to the first inverted pull-up signal PUB1. The NMOS transistor N42 may drive the first output data DOUT1 with the ground voltage VSS in response to the first pull-down signal PD1.

Hereinbelow, operations of the first driving signal generation unit 41 and the first output driver 42 will be described by being divided into the examples where the first internal data IDATA1 is a logic high level and the examples where the first internal data IDATA1 is a logic low level.

In the example where the first internal data IDATA1 is the logic high level, the first driving signal generation unit 41 may generate the first pull-up signal PU1 which is driven to the level of the ground voltage VSS, the first inverted pull-up signal PUB1 which is driven to the level of the second power supply voltage VDD2, and the first pull-down signal PD1 which is driven to the level of the ground voltage VSS. The first output driver 42 may be inputted with the first pull-up signal PU1, the first inverted pull-up signal PUB1, and the first pull-down signal PD1, and may drive the first output data DOUT1 with the internal power supply voltage IVDD. In general, a PMOS transistor has a good driving force in the example of driving a voltage with a higher level, and an NMOS transistor has a good driving force in the example of driving a voltage with a lower level. Therefore, in the example of pull-up driving the first output data DOUT1 by using the PMOS transistor P41 and the NMOS transistor N41, the NMOS transistor N41 is used to drive the first output data DOUT1 during an initial period in which the first output data DOUT1 rises to the level of the internal power supply voltage IVDD and the PMOS transistor P41 is used to drive the first output data DOUT1 after the initial period, whereby a driving force may be increased.

In the example where the first internal data IDATA1 is the logic low level, the first driving signal generation unit 41 may generate the first pull-up signal PU1 which is driven to the level of the second power supply voltage VDD2, the first inverted pull-up signal PUB1 which is driven to the level of the ground voltage VSS, and the first pull-down signal PD1 which is driven to the level of the second power supply voltage VDD2. The first output driver 42 may be inputted with the first pull-up signal PU1, the first inverted pull-up signal PUB1 and the first pull-down signal PD1, and drive the first output data DOUT1 with the ground voltage VSS. Since the second power supply voltage VDD2 applied to the gate terminal of the NMOS transistor N42 has a level higher than the internal power supply voltage IVDD supplied to the first output driver 42, the driving force of the NMOS transistor N42 may be increased.

Figure 5:
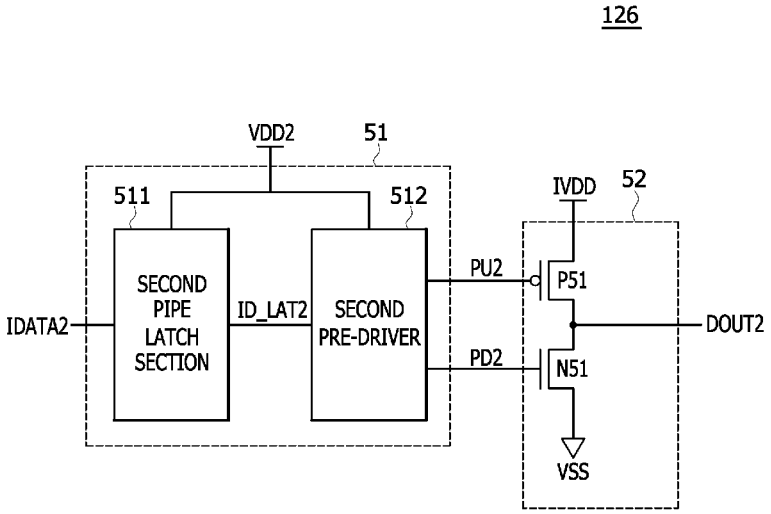
FIG. 5 is a diagram illustrating a representation of an example of the configuration of the second output data generation block illustrated in FIG. 1.

Referring to FIG. 5, the second output data generation block 126 may include a second driving signal generation unit 51 and a second output driver 52.

The second driving signal generation unit 51 may include a second pipe latch section 511 and a second pre-driver 512. The second pipe latch section 511 may be supplied with the second power supply voltage VDD2, may align and latch the second internal data IDATA2, and output second latch data ID_LAT2. The second pre-driver 512 may be supplied with the second power supply voltage VDD2, and may generate a second pull-up signal PU2 and a second pull-down signal PD2 in response to the second latch data ID_LAT2.

The second output driver 52 may include a PMOS transistor P51 and an NMOS transistor N51. The PMOS transistor P51 may drive the second output data DOUT2 with the internal power supply voltage IVDD in response to the second pull-up signal PU2. The NMOS transistor N51 may drive the second output data DOUT2 with the ground voltage VSS in response to the second pull-down signal PD2.

Hereinbelow, operations of the second driving signal generation unit 51 and the second output driver 52 will be described by being divided into the examples where the second internal data IDATA2 is a logic high level and the examples where the second internal data IDATA2 is a logic low level.

In the example where the second internal data IDATA2 is the logic high level, the second driving signal generation unit 51 may generate the second pull-up signal PU2 and the second pull-down signal PD2 which are driven to the level of the ground voltage VSS. The second output driver 52 may be inputted with the second pull-up signal PU2 and the second pull-down signal PD2, and may drive the second output data DOUT2 with the internal power supply voltage IVDD.

In the example where the second internal data IDATA2 is the logic low level, the second driving signal generation unit 51 generates the second pull-up signal PU2 and the second pull-down signal PD2 which are driven to the level of the second power supply voltage VDD2. The second output driver 52 may be inputted with the second pull-up signal PU2 and the second pull-down signal PD2, and may drive the second output data DOUT2 with the ground voltage VSS. Since the second power supply voltage VDD2 applied to the gate terminal of the PMOS transistor P51 has a level higher than the internal power supply voltage IVDD supplied to the source terminal of the PMOS transistor P51, leakage current through the PMOS transistor P51 may be reduced. Since the second power supply voltage VDD2 applied to the gate terminal of the NMOS transistor N51 has a level higher than the internal power supply voltage IVDD supplied to the second output driver 52, the driving force of the NMOS transistor N51 may be increased.

Figure 6:
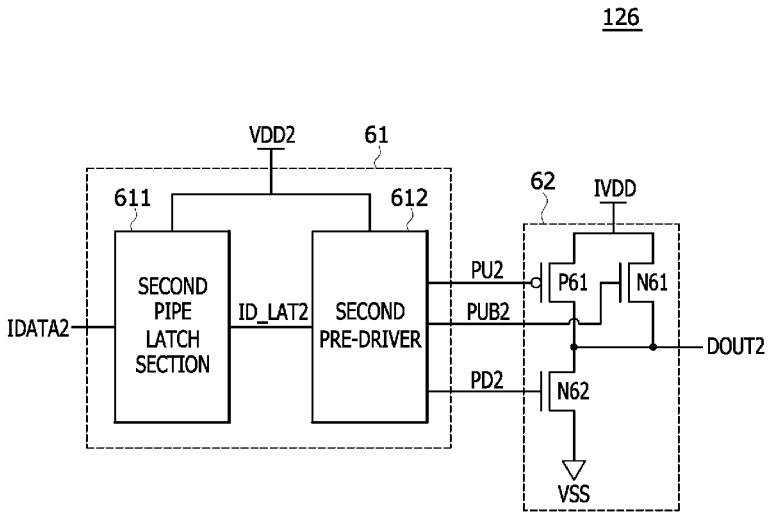
FIG. 6 is a diagram illustrating a representation of an example of the configuration of the second output data generation block illustrated in FIG. 1.

FIG. 6 is a diagram illustrating a representation of an example of the configuration of the second output data generation block 126 illustrated in FIG. 1. Referring to FIG. 6, a second driving signal generation unit 61 may include a second pipe latch section 611 and a second pre-driver 612. The second pipe latch section 611 may be supplied with the second power supply voltage VDD2, may align and latch the second internal data IDATA2, and may output second latch data ID_LAT2. The second pre-driver 612 may be supplied with the second power supply voltage VDD2, and may generate a second pull-up signal PU2, a second inverted pull-up signal PUB2 and a second pull-down signal PD2 in response to the second latch data ID_LAT2.

A second output driver 62 may include a PMOS transistor P61 and NMOS transistors N61 and N62. The PMOS transistor P61 may drive the second output data DOUT2 with the internal power supply voltage IVDD in response to the second pull-up signal PU2. The NMOS transistor N61 may drive the second output data DOUT2 with the internal power supply voltage IVDD in response to the second inverted pull-up signal PUB2. The NMOS transistor N62 may drive the second output data DOUT2 with the ground voltage VSS in response to the second pull-down signal PD2.

Hereinbelow, operations of the second driving signal generation unit 61 and the second output driver 62 will be described by being divided into the examples where the second internal data IDATA2 is a logic high level and the examples where the second internal data IDATA2 is a logic low level.

In the example where the second internal data IDATA2 is the logic high level, the second driving signal generation unit 61 may generate the second pull-up signal PU2 which is driven to the level of the ground voltage VSS, the second inverted pull-up signal PUB2 which is driven to the level of the second power supply voltage VDD2, and the second pull-down signal PD2 which is driven to the level of the ground voltage VSS. The second output driver 62 may be inputted with the second pull-up signal PU2, the second inverted pull-up signal PUB2 and the second pull-down signal PD2, and drive the second output data DOUT2 with the internal power supply voltage IVDD. In general, a PMOS transistor has a good driving force in the example of driving a voltage with a higher level, and an NMOS transistor has a good driving force in the example of driving a voltage with a lower level. Therefore, in the example of pull-up driving the second output data DOUT2 by using the PMOS transistor P61 and the NMOS transistor N61, the NMOS transistor N61 is used to drive the second output data DOUT2 during an initial period in which the second output data DOUT2 rises to the level of the internal power supply voltage IVDD and the PMOS transistor P61 is used to drive the second output data DOUT2 after the initial period, whereby a driving force may be increased.

In the example where the second internal data IDATA2 is the logic low level, the second driving signal generation unit 61 may generate the second pull-up signal PU2 which is driven to the level of the second power supply voltage VDD2, the second inverted pull-up signal PUB2 which is driven to the level of the ground voltage VSS, and the second pull-down signal PD2 which is driven to the level of the second power supply voltage VDD2. The second output driver 62 may be inputted with the second pull-up signal PU2, the second inverted pull-up signal PUB2 and the second pull-down signal PD2, and may drive the second output data DOUT2 with the ground voltage VSS. Since the second power supply voltage VDD2 applied to the gate terminal of the NMOS transistor N62 has a level higher than the internal power supply voltage IVDD supplied to the second output driver 62, the driving force of the NMOS transistor N62 may be increased.

Figure 7:
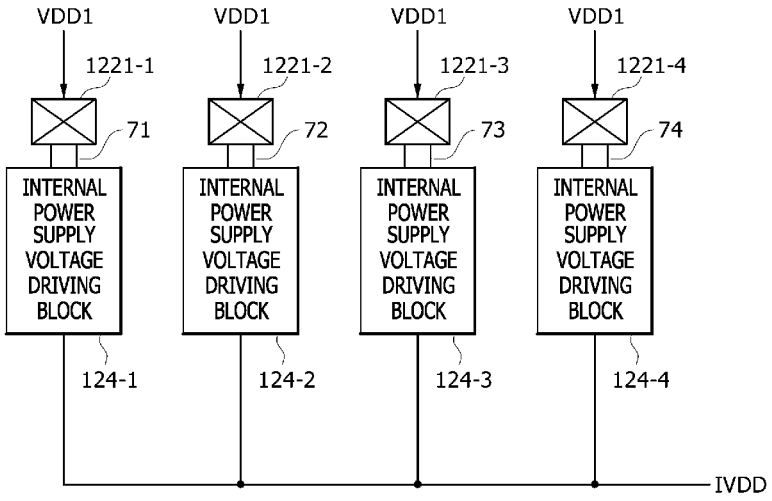
FIG. 7 is a diagram illustrating a representation of an example of pads and internal power supply voltage driving blocks in accordance with an embodiment.

FIG. 7 is a diagram illustrating a representation of an embodiment in which a first power supply voltage VDD1 is supplied through a plurality of pads 1221-1, 1221-2, 1221-3 and 1221-4. In the example where the first power supply voltage VDD1 is supplied through the plurality of pads 1221-1, 1221-2, 1221-3 and 1221-4, a plurality of internal power supply voltage driving blocks 124-1, 124-2, 124-3 and 124-4 may be positioned respectively adjacent to the plurality of pads 1221-1, 1221-2, 1221-3 and 1221-4 and may be supplied with the first power supply voltage VDD1. In the example where the pads 1221-1, 1221-2, 1221-3 and 1221-4 and the internal power supply voltage driving blocks 124-1, 124-2, 124-3 and 124-4 are adjacent to each other, the lengths of transmission lines 71, 72, 73 and 74 for transmitting the first power supply voltage VDD1 may be shortened, whereby leakage current may be reduced. Because the internal power supply voltage driving blocks 124-1, 124-2, 124-3 and 124-4 are realized by the same circuit and perform the same operation as the internal power supply voltage driving block 124 illustrated in FIG. 2, detailed descriptions thereof will be omitted herein.

Figure 8:
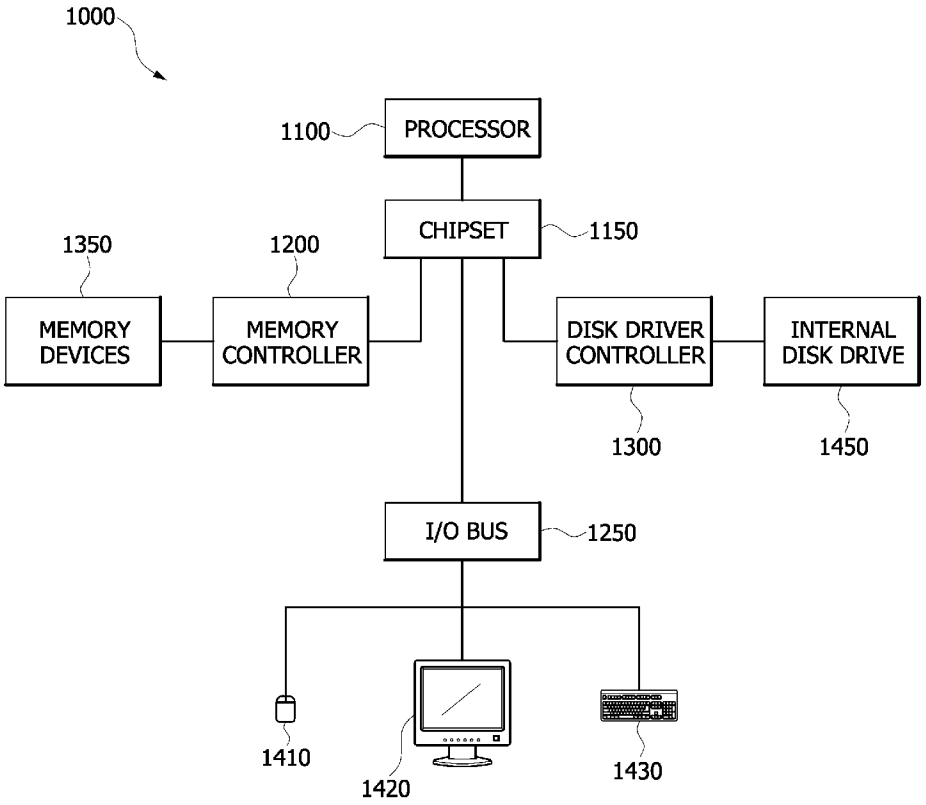
FIG. 8 illustrates a block diagram of an example of a representation of a system employing a semiconductor system and or semiconductor device in accordance with the various embodiments discussed above with relation to FIGS. 1-7.

The semiconductor devices and/or semiconductor systems discussed above (see FIGS. 1-7) are particular useful in the design of memory devices, processors, and computer systems. For example, referring to FIG. 8, a block diagram of a system employing a semiconductor device and/or semiconductor system in accordance with the various embodiments are illustrated and generally designated by a reference numeral 1000. The system 1000 may include one or more processors (i.e., Processor) or, for example but not limited to, central processing units ("CPUs") 1100. The processor (i.e., CPU) 1100 may be used individually or in combination with other processors (i.e., CPUs). While the processor (i.e., CPU) 1100 will be referred to primarily in the singular, it will be understood by those skilled in the art that a system 1000 with any number of physical or logical processors (i.e., CPUs) may be implemented.

A chipset 1150 may be operably coupled to the processor (i.e., CPU) 1100. The chipset 1150 is a communication pathway for signals between the processor (i.e., CPU) 1100 and other components of the system 1000. Other components of the system 1000 may include a memory controller 1200, an input/output ("I/O") bus 1250, and a disk driver controller 1300. Depending on the configuration of the system 1000, any one of a number of different signals may be transmitted through the chipset 1150, and those skilled in the art will appreciate that the routing of the signals throughout the system 1000 can be readily adjusted without changing the underlying nature of the system 1000.

As stated above, the memory controller 1200 may be operably coupled to the chipset 1150. The memory controller 1200 may include at least one semiconductor device and/or semiconductor system as discussed above with reference to FIGS. 1-7. Thus, the memory controller 1200 can receive a request provided from the processor (i.e., CPU) 1100, through the chipset 1150. In alternate embodiments, the memory controller 1200 may be integrated into the chipset 1150. The memory controller 1200 may be operably coupled to one or more memory devices 1350. In an embodiment, the memory devices 1350 may include the at least one semiconductor device and/or semiconductor system as discussed above with relation to FIGS. 1-7, the memory devices 1350 may include a plurality of word lines and a plurality of bit lines for defining a plurality of memory cells. The memory devices 1350 may be any one of a number of industry standard memory types, including but not limited to, single inline memory modules ("SIMMs") and dual inline memory modules ("DIMMs"). Further, the memory devices 1350 may facilitate the safe removal of the external data storage devices by storing both instructions and data.

The chipset 1150 may also be coupled to the I/O bus 1250. The I/O bus 1250 may serve as a communication pathway for signals from the chipset 1150 to I/O devices 1410, 1420, and 1430. The I/O devices 1410, 1420, and 1430 may include, for example but are not limited to, a mouse 1410, a video display 1420, or a keyboard 1430. The I/O bus 1250 may employ any one of a number of communications protocols to communicate with the I/O devices 1410, 1420, and 1430. In an embodiment, the I/O bus 1250 may be integrated into the chipset 1150.

The disk driver controller 1300 may be operably coupled to the chipset 1150. The disk driver controller 1300 may serve as the communication pathway between the chipset 1150 and one internal disk driver 1450 or more than one internal disk driver 1450. The internal disk driver 1450 may facilitate disconnection of the external data storage devices by storing both instructions and data. The disk driver controller 1300 and the internal disk driver 1450 may communicate with each other or with the chipset 1150 using virtually any type of communication protocol, including, for example but not limited to, all of those mentioned above with regard to the I/O bus 1250.

It is important to note that the system 1000 described above in relation to FIG. 8 is merely one example of a system 1000 employing a semiconductor device and/or semiconductor system as discussed above with relation to FIGS. 1-7. In alternate embodiments, such as, for example but not limited to, cellular phones or digital cameras, the components may differ from the embodiments illustrated in FIG. 8.

While various embodiments have been described above, it will be understood to those skilled in the art that the embodiments described are by way of example only. Accordingly, the semiconductor device and the semiconductor system including the same described herein should not be limited based on the described embodiments.

What is claimed is:

1. A semiconductor system comprising:

a first semiconductor device configured to output a command signal, a first power supply voltage, a second power supply voltage and a third power supply voltage; and a second semiconductor device configured to drive an internal power supply voltage with the first power supply voltage in response to an internal command signal generated by decoding the command signal, generate first output data from first internal data by being supplied with the internal power supply voltage and the second power supply voltage, and generate second output data from second internal data by being supplied with the internal power supply voltage and the second power supply voltage, wherein the second semiconductor device comprises:

an internal power supply voltage driving block configured to drive the internal power supply voltage with the first power supply voltage in response to the internal command signal;

a first output data generation block configured to be supplied with the internal power supply voltage and the second power supply voltage, and generate the first output data from the first internal data; and a second output data generation block configured to be supplied with the internal power supply voltage and the second power supply voltage, and generate the second output data from the second internal data.

2. The semiconductor system according to claim 1, wherein the internal power supply voltage is driven with the first power supply voltage when a read operation is being performed.

3. The semiconductor system according to claim 1, wherein the first power supply voltage has a level lower than the second power supply voltage, and the second power supply voltage has a level lower than the third power supply voltage.

4. The semiconductor system according to claim 1, wherein the second semiconductor device includes a pad, wherein the first power supply voltage is inputted to the second semiconductor device though the pad, and wherein the internal power supply voltage driving block is positioned adjacent to the pad.

5. The semiconductor system according to claim 1, wherein the internal power supply voltage driving block comprises:

a buffer element configured to be supplied with the third power supply voltage, buffer the internal command signal, and generate a driving control signal; and a driving element configured to drive the internal power supply voltage with the first power supply voltage in response to the driving control signal, wherein, when the read operation is not being performed, the driving element interrupts driving of the internal power supply voltage in response to the driving control signal driven with the third power supply voltage.

6. The semiconductor system according to claim 1, wherein the first output data generation block comprises:

a driving signal generation unit configured to be supplied with the second power supply voltage, and to generate a pull-up signal and a pull-down signal in response to the first internal data; and an output driver configured to be supplied with the internal power supply voltage, and drive the first output data in response to the pull-up signal and the pull-down signal.

7. The semiconductor system according to claim 6, wherein the driving signal generation unit comprises:

a pipe latch section configured to be supplied with the second power supply voltage, align and latch the first internal data, and output latch data; and a pre-driver configured to be supplied with the second power supply voltage, and generate the pull-up signal and the pull-down signal in response to the latch data.

8. The semiconductor system according to claim 6, wherein the output driver comprises:

a first MOS transistor configured to drive the first output data with the internal power supply voltage in response to the pull-up signal; and a second MOS transistor configured to drive the first output data with a ground voltage in response to the pull-down signal.

9. The semiconductor system according to claim 8, wherein the driving signal generation unit further generates an inverted pull-up signal in response to the first internal data.

10. The semiconductor system according to claim 9, wherein the output driver further comprises:

a third MOS transistor configured to drive the first output data with the internal power supply voltage in response to the inverted pull-up signal.

11. The semiconductor system according to claim 1, wherein the second power supply voltage is greater than the internal power supply voltage.

12. A semiconductor device comprising:

an internal power supply voltage driving block configured to drive an internal power supply voltage with a first power supply voltage in response to an internal command signal;

a first output data generation block configured to be supplied with the internal power supply voltage and a second power supply voltage, and generate first output data from first internal data; and a second output data generation block configured to be supplied with the internal power supply voltage and the second power supply voltage, and generate second output data from second internal data.

13. The semiconductor device according to claim 12, wherein the internal power supply voltage is driven with the first power supply voltage when a read operation is being performed.

14. The semiconductor device according to claim 12, wherein the internal power supply voltage driving block comprises:

a buffer element configured to be supplied with a third power supply voltage, buffer the internal command signal, and generate a driving control signal; and a driving element configured to drive the internal power supply voltage with the first power supply voltage in response to the driving control signal, wherein, when the read operation is not being performed, the driving element interrupts driving of the internal power supply voltage in response to the driving control signal driven with the third power supply voltage.

15. The semiconductor device according to claim 14, wherein the first power supply voltage has a level lower than the second power supply voltage, and the second power supply voltage has a level lower than the third power supply voltage.

16. The semiconductor device according to claim 12, wherein the second power supply voltage is greater than the internal power supply voltage.

17. A semiconductor device comprising:

an internal power supply voltage driving block configured to drive an internal power supply voltage with a first power supply voltage in response to an internal command signal when a read operation is being performed;

a driving signal generation unit configured to be supplied with a second power supply voltage, and generate a pull-up signal and a pull-down signal in response to internal data; and an output driver configured to be supplied with the internal power supply voltage, and drive output data in response to the pull-up signal and the pull-down signal.

18. The semiconductor device according to claim 17, wherein the first power supply voltage has a level lower than the second power supply voltage.

19. The semiconductor device according to claim 17, wherein the output driver comprises:

a first MOS transistor configured to drive the output data with the internal power supply voltage in response to the pull-up signal; and a second MOS transistor configured to drive the output data with a ground voltage in response to the pull-down signal.

20. The semiconductor device according to claim 19, wherein the driving signal generation unit further generates an inverted pull-up signal in response to the internal data.

21. The semiconductor device according to claim 20, wherein the output driver further comprises:

a third MOS transistor configured to drive the output data with the internal power supply voltage in response to the inverted pull-up signal.

22. The semiconductor device according to claim 17, wherein the second power supply voltage is greater than the internal power supply voltage.

* * * * *